United States Patent [19]

Arbter

[11] 4,034,634

[45] July 12, 1977

[54] APPARATUS AND METHOD FOR UNWINDING AND CUTTING A FABRIC WEB INTO INDIVIDUAL UNIFORM LENGTHS

[76] Inventor: Conrad Arbter, Mittelweg 9, Saal an der Saale, Germany, 8741

[21] Appl. No.: 723,227

[22] Filed: Sept. 15, 1976

[30] Foreign Application Priority Data

Oct. 3, 1975 Germany ..... 2544410

[51] Int. Cl.[2] ..... B26D 5/42; B65H 17/36; B65H 23/16

[52] U.S. Cl. ..... 83/18; 83/36; 83/42; 83/175; 83/215; 83/251; 83/277; 83/278; 83/282; 83/418; 83/639; 83/649

[58] Field of Search ..... 83/18, 36, 42, 175, 83/215, 228, 251, 277, 278, 282, 418, 639, 649

[56] References Cited

U.S. PATENT DOCUMENTS

| | | | |
|---|---|---|---|
| 2,966,086 | 12/1960 | Sjöstrom | 83/175 |
| 3,182,536 | 5/1965 | Sumpter, Jr. et al. | 83/18 |
| 3,192,811 | 7/1965 | Simmons | 83/175 |
| 3,306,144 | 2/1967 | Nordgren | 83/175 X |
| 3,877,333 | 4/1975 | Illingworth et al. | 83/251 X |

*Primary Examiner*—Frank T. Yost
*Attorney, Agent, or Firm*—McGlew and Tuttle

[57] ABSTRACT

An apparatus or system for the aligning and severing of fabric webs which have a thickness differing in the longitudinal direction, for example a terry cloth fabric with napless lanes extending crosswise to the longitudinal direction and lanes which have a nap arranged in an alternate pattern comprises aligning means which cooperate with the boundary areas between adjacent lanes of the fabric web and which extend crosswise to the web pull off direction. A cutting device is arranged crosswise to the web pull off direction at a location after the aligning means and braking means in the form of individually adjustable brake elements which extend across the width of the fabric are arranged between the aligning means and the reel supply of the fabric material. The aligning means includes an alignment device which may be positioned in contact with the fabric for example at the location of the fabric which does not have any nap and the alignment means includes a plurality of individual shoes which are biased into engagement with the fabric at spaced lateral locations along the width. The individual shoes are supported by a member that is guided by a carriage which moves in the pull off direction with the shoes biased into engagement with the fabric material. Simultaneously with the engagement of the alignment means individual braking elements are moved into engagement with the fabric between the alignment means and the reel supply and these individual braking elements are adjusted to provide a braking action on the fabric which facilitates the straightening of the fabric along with the movement of the engagement shoes in the napless section toward the boundary line of the section which has the naps.

13 Claims, 6 Drawing Figures

APPARATUS AND METHOD FOR UNWINDING AND CUTTING A FABRIC WEB INTO INDIVIDUAL UNIFORM LENGTHS

BACKGROUND OF THE INVENTION

1. Field of the Invention

This invention relates in general to an apparatus and method for unwinding and cutting a uniform length of material from a fabric and in particular to a new and useful device and method for aligning boundary edges between lengths of fabric of varying thicknesses.

2. Description of the Prior Art

The invention relates to a system for the aligning and thread-true severing of fabric webs having a thickness differing in a longitudinal direction, for example, terry cloth with alternate napless lanes and lanes with nap extending crosswise to the longitudinal direction. In unwinding fabric webs from supply rolls it happens frequently that the web is distorted in itself, that is, in fabric webs made of warp and weft threads the weft threads run obliquely and/or crookedly.

In a known system (Swiss Pat. 1 22 573) for the thread-true cutting of fabric webs, the fabric web, retained at one end but otherwise freely resting on a table top, is smoothed during severing by means of a brush preceding the knife and is aligned thread-true by a needle positioned before the knife in the prolongation of the cutting line and engaging into the thread lane between two weft threads. This method, however, will give reliable results only if the fabric web has relatively thick and smooth weft threads, which form relatively deep and even thread lanes. Besides, the fabric web to be aligned must not be too large or too heavy, as otherwise there is danger that the aligning needle will not align the fabric web thread-true in the desired manner, but will run over the weft threads sideways.

In another known system (German Disclosure 1,535,999) for the thread-true severing of fabric webs provided with tear-line weft threads, a carriage movable crosswise to the pull off direction is arranged, which carries a second carriage displaceable parallel to the pull off direction by manual rotation of a shaft. A severing device comprising a circular knife is arranged on the second carriage. With the second carriage are connected two needle strips present below the fabric web laid out flat, one of which is arranged to the left and the other to the right of the cutting line. The needle strips carry pivotable needle holders which are held first in an inoperative position. During cutting, the needle holders are released successively by release pins arranged in the vicinity of the circular knife, owing to which the needle holders swing up and the correlated needles penetrate into the fabric web, retaining it. If the way the tear line weft thread runs is crooked or not at right angles, then during the displacement movement of the first carriage, the second carriage with the severing device and the needle strips is continuously made to flow the tear line weft thread by rotation of said shaft. While it is true that in this way it is achieved that the cutting line runs parallel to the tear line weft thread and the cutting edges are aligned in a straight line, the system for the practice of this method is exceedingly expensive and complicated in comparison to the first-named system. In addition, the continual manual comparing between the course of the tear line weft thread and the respective cutting line of the severing knife and the possibly necessary shifting of the second carriage requires a steady high attention of the operator, soon resulting in fatigue, which may cause faulty working.

SUMMARY OF THE INVENTION

To overcome the disadvantages indicated, the invention provides for the thread-true severing of fabric webs having different thickness in longitudinal direction, such as terry cloth with napless lanes and nap lanes running crosswise to the web pull off direction, a system where an aligning means which can be placed against a boundary area of a thickness graduation of the fabric web is displaceable parallel to the corrective movement of the fabric web.

The solution of this problem is characterized in that the aligning means is adapted to the width of the fabric web and is displaceable parallel to the web pull off direction, and that between the fabric supply roll and the aligning means several brake elements arranged side by side crosswise to the pull off direction and acting on the fabric web during that aligning are provided having means for independently adjusting each brake element.

In a terry cloth with napless lanes, the front edge of the fabric web being clamped at right angles, the aligning means is lowered into the napless lane in which the severing of a workpiece, for example a towel, is to take place. After the lowering, the aligning means is displaced in the direction of the front edge of the fabric web. When the fabric web is distorted, the aligning means will first apply against the part of the boundary area of the nap layer farthest removed from the front edge, exerting a tensile force on it. Thereby the part of the fabric web extending from the contact area between the aligning means and the boundary area of the nap layer, parallel to the pull off direction, is pulled through under the correlated brake element, while the adjoining part of the fabric web which is not yet seized by the aligning means at first substantially retains its original position. To support this aligning movement, the brake force of the individual brake elements is adapted to the fabric web which is uniformly distorted over relatively long distances in such a way that in the zones if existing great distortion or misalignment the brake elements exert a lesser brake force than in the zones of less distortion. By the cooperation of the aligning means and the brake elements, not only the boundary area of the nap layer — originally extending obliquely and/or crookedly — but also the weft threads in the napless lane are aligned at right angles and rectilinearly, so that then a thread true cut can be made.

By the adaptation of the aligning means to the width of the fabric web and the displacement in the direction of the corrective movement of the fabric web, the advantage of an area contact between the aligning means and the boundary area of the nap layer is obtained, the size of the contact area increasing in the course of the aligning operation and hence the specific area pressure decreasing. It is thus avoided that at high aligning forces the aligning means penetrates into the nap layer or compresses it and then slides over it. In the system according to the invention the aligning of the fabric web thus occurs in a particularly simple and yet reliable manner, the entire aligning operation taking place fully automatically. Another advantage is that the pull-off movement of the fabric web from the supply roll and the displacement of the aligning means, occurring in the same direction, can be carried out in time periods which overlap.

In the case of terry cloth with napless lanes which are narrow and at the same time extend at a great oblique angle, it may happen that the aligning means on being lowered does not get into the lane completely, but in part still rests on the nap layer present before the lane. In order that satisfactory aligning can take place also in such a case, the aligning means consists, according to a further proposal of the invention, of several aligning elememts arranged side by side crosswise to the web pull-off direction and movable singly in vertical direction to engage the material. It thereby becomes possible for the aligning elements lying in the region of the lane or area of napless construction to enter the lane and to perform the aligning during the subsequent displacement of the aligning means. Meanwhile the aligning elements lying on the nap layer slide either by gravity or under slight spring pressure over the nap layer without hindering the aligning process until they too finally move to the boundary of or enter the partially aligned lane, or the lane having the nap, and participate in the rest of the aligning process.

It is further proposed by the invention to position the aligning elements and the brake elements in line with each other, so that they lie on common action lines.

According to a further proposal of the invention, the aligning means is arranged on a carriage displaceable parallel to the web pull-off direction, the severing device being arranged thereon at adjustable distance from the aligning means. Since within a fabric web the napless lanes are normally woven equally wide, the distance between the aligning means and the severing device needs to be adjusted to the measure of one half lane width only once, to maintain the severing cut exactly in the middle of the napless lanes in all subsequent severing operations. According to a further proposal of the invention, the severing device comprises a knife corresponding to the width of the fabric web and movable perpendicularly to the plane thereof. By the measure of adapting also the severing knife to the width of the fabric web and moving it perpendicularly to the fabric plane, the total time required in the system according to the invention for the two operations of aligning and severing, taking place one after the other, is very much shorter than in the systems known in the prior art, in which the aligning means and the severing knife are pulled crosswise to the web pull-off direction over or through the fabric web.

In order that, after the severing operation, the fabric web, having been partly stretched between the brake elements and the aligning means during the aligning, will not snap back into the old starting position, a further proposal of the invention provides for moving the fabric web below a pressing strip arranged in web pull-off direction before the cutting line of the severing knife, before the severing is carried out.

Accordingly it is an object of the invention to provide a method of unwinding and cutting a fabric web has an individual longitudinally adjacent length of thick width and thin width areas, into individual lengths from a reel supply of the fabric which comprises pulling off the length of the fabric and engaging the fabric at a thin width area at a plurality of laterally aligned locations extending across the width of the fabric and with a predetermined engaging force which is maintained while applying individual braking pressures at a number of locations corresponding to the engaging forces areas between the reel supply and the engaging force areas and while advancing the engaging force areas in the direction of pull off of the fabric so as to extend and stretch and realign the distorted portions as the engagement areas are moved toward a boundary between the areas and individual ones of the engagement areas come to the boundary while the other areas extend and straighten the remaining areas for alignment before the fabric is moved into a position for cutting.

A further object of the invention is to provide a system or apparatus for aligning and severing of fabric webs which has a thickness differing in the longitudinal direction for example in respect to a material such as terry cloth having alternately arranged napless lanes and lanes with nap extending crosswise to the longitudinal direction and which comprises a reel supply of fabric with means engageable with the fabric for pulling it off from the reel supply and moving it in a pull off direction to position preferably the napless lane in alignment with alignment means which extend across the width of the fabric ahead of the cutting device having means for cutting across the whole width of the fabric and wherein the alignment means comprises a plurality of laterally spaced shoes or elements engageable across the width of the fabric and which are carried on a carriage which is displaceable therewith in the pull off direction cooperates with a plurality of brake elements arranged side by side and crosswise to the pull off direction and which act on the fabric between the reel supply and the aligning means and which includes means for individually adjusting the brake element so as to effect together with the alignment means a realignment of the fabric material prior to cutting.

A further object of the invention is to provide an apparatus and method for aligning fabric which is pulled off a reel supply and which is simple in design and concept, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there is illustrated a preferred embodiment of the invention.

GENERAL DESCRIPTION OF THE PREFERRED EMBODIMENTS

Figure 6:
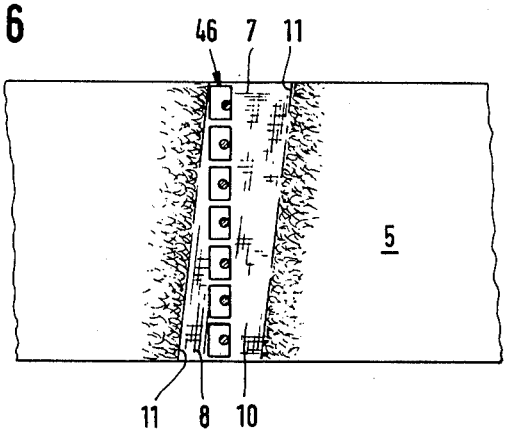
FIG. 6 is a top plan view of the aligning mechanism showing an initial view of the alignment means during the alignment process.

Referring to the drawings in particular, the invention embodied therein comprises a device for pulling off fabric such as terry cloth 5 from a reel supply 4 thereof which is mounted on a bracket 3 of holding plate of a frame 1. The pull off mechanism 52 is effective to pull off a length of fabric material and to position napless areas 10 or areas having less of a thickness into alignment with alignment means 46 which is arranged adjacent cutting means generally designated 39 which is made effective to cut in this napless area 10 only after the fabric has been aligned across the width of the support table or bed plate 2. For this purpose the alignment means 46 is carried on a carriage 29 which is displaceable backwardly and forwardly on longitudinally extending guide bars 28 and this aligning operation is carried out in conjunction with braking means in the form of individual brake elements 16 which engage the fabric behind the location of the alignment means 46 which may be adjusted by adjustment means 20 to facilitate the gradual alignment of the web across its width as shown in FIG. 6 by the plurality of individual alignment shoes 45 of the alignment means acting in conjunction with the individual brake elements during the movement of the alignment means in the napless section 10 toward the section having nap thereon which begins at a border line 11.

Two holding arms 3 are mounted on the frame 1 for the supply roll 4, also referred to as a fabric reel-supply or bolt, of a terry cloth 5. The terry cloth 5 consists of a continuous ground fabric 6, which is constructed from warp threads 7 extending parallel to the pull off or feed direction A and weft threads 8 extending crosswise thereof and a nap area or lane 9, which is interrupted by napless areas or lanes 10 of constant width, extending crosswise to the pull off direction A. The distances between the lanes 10 determine the length of the object to be produced, in this case towels. The boundary lines between the areas 9 and 10 which extend crosswise to the pull off direction A, are designated by 11.

Two arms 12 are fastened on the frame 1 and an axle 13 extending crosswise to the pull off direction A is arranged therebetween. Several supports 14 are mounted side by side on the axle 13 for free rotation. On the side toward the supply roll 4, each support 14 has a fork 15, in which brake means in the form of a brake wheel 16 is arranged. On each support 14 is fastened a substantially horizontal flat spring 17, which carries a brake shoe 18 mounted over the brake wheel 16. The relatively narrow portion of each support 14, present above the flat spring 17, comprises at its front end a bent tab 19, which carries an adjusting screw 20 acting on the flat spring 17. At the rear end of each support 14 an arm 21 is formed, which carries a freely rotatable wheel 22. Due to their dead weight, the supports 14 pivot clockwise (according to FIG. 1), so that the brake wheels 16 rest on the terry cloth 5.

Figure 5:
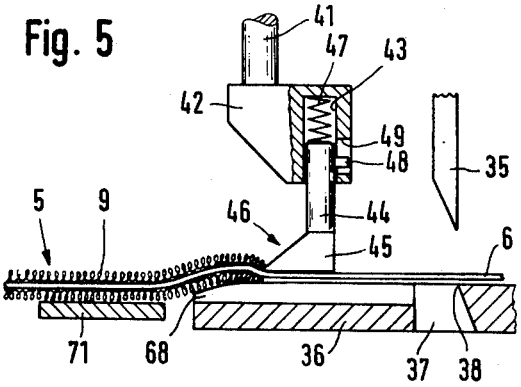
FIG. 5 is an enlarged longitudinal section of the aligning mechanism.

On the frame 1, two arms 23 are fastened, which carry a support plate 24 extending crosswise to the pull off direction A. Two compressed air cylinders 25 are arranged on the support plate 24 which have piston rods 26 with a pressing strip 27. A carriage 29 is displaceable arranged on two guide bars 28 extending parallel to the pull off direction A. On the side ends of the carriage 29 two arms 30 are fastened, which carry a support plate 31. On the side toward the brake wheels 16 there is fastened to the support plate 31 a trigger plate 32 which is bent upwardly at its free end. On the support plate 31 are arranged two compressed air cylinders 33 having piston rods 34 which carry a severing knife 35 extending crosswise to the pull off direction A. The knife 35 has a width greater than the width of the terry cloth 5. Between the arms 30 a horizontally aligned plate 36 is fastened, which comprises a slot 37 for the passage of the knife edge of the knife 35, the edge 38 of slot 37 being designed as counter-knife edge (FIG. 5). The compressed air cylinders 33, the knife 35 and the edge 38 form a severing device or cutter 39.

The support plate 31 also carries two compressed air cylinders 40, 40 to whose piston rods 41 a straightening strip 42 extending crosswise to the pull off direction A is fastened. The straightening strip 42 has several vertically extending bores 43 (FIG. 5), which are closed toward the top. A guide rod 44 is arranged in each bore 43 which carries, at its lower end, a wedge-shaped shoe 45. The guide rods 44 and shoes 45 form an aligning element 46. In each bore 43 a compression spring 47 is provided, which pushes the correlated aligning element 46 downward. A pin 48 is fastened in each guide rod 4 and it engages into a vertically extending slot 49 provided in the straightening strip 42. Each pin 48 has its own slot 49 assigned to it. Thereby a suspension shoe 45, secured against rotation, is achieved. In addition the pin 48 forms an abutment which prevents the aligning elements 46 from falling out when the straightening strip 42 is raised. Parts 42 and 49 together form an aligning means corresponding to the width of the terry cloth 5. As many aligning elements 46 are provided as there are brake wheels 16, and the aligning elements 46 and the brake wheels 16 are in line with each other relative to the pull off direction A.

A compressed air cylinder 50 fastened on frame 1 has piston rod 51 connected with the carriage 29 for displacing it backwardly and forwardly. The distance between the aligning elements 46 and the severing device 39 can also be adjusted by means (not shown) in order to adapt the device to variations of width of the napless lanes 10.

A pull off device 52 comprises two guide rods 53 fastened to the frame 1 and extending parallel to the pull off direction A. Each rod 53 carries a displaceable guide piece 54 which are rigidly connected together by a support plate 55. On the underside of the support plate 55 several mutually spaced arms 56, protruding over the support plate 55 counter to the pull off direction A, are fastened. In the two guide pieces 54 a shaft 57 is mounted, freely rotatable. Above the arms 56, the same number of angle pieces 58 are arranged on the shaft 57, each secured against rotation. The arms 56 and angle pieces 58 are correlated to each other in pairs which form clamps 59. A two-armed lever 60 is fastened to one end of shaft 57 which protrudes from one guide piece 54. An abutment piece 61 is fastened to said guide piece 54 in the pivot zone of the upper end of the lever 60. At the lower end of lever 60 a chain 62 is fastened. The chain 62 is driven by a motor 63 arranged on frame 1, on the shaft 64 of which a sprocket wheel 65 is fastened. Chain 62 runs over another sprocket wheel 66, which is mounted freely rotatable on a bolt 67 fastened on frame 1. When the clamps 59 which engage the material are present in the end position near the aligning elements 46, the arms 56 lie in matching shallow grooves 68 of plate 36.

Laterally of the movement zone of the clamps 59 there is fastened in frame 1 an axle 69 on which several guide rolls 70 are arranged. Over the guide rolls 70 are passed conveyor belts 71 of a known cross-conveyor device 72, whose device is not shown. Between the middle conveyor belts 71 a folding stave 73 is arranged which is movable up and down vertically, whose suspension and drive are not shown.

The system operates with a follow-up control, i.e. at the end of each operational step the start of the next step is activated. The switching on and off of the motor 63 and the connection and disconnection of the compressed air for the individual compressed air cylinders 25, 33, 40 and 50 occurs for example through limit switches known in themselves.

Figure 3:
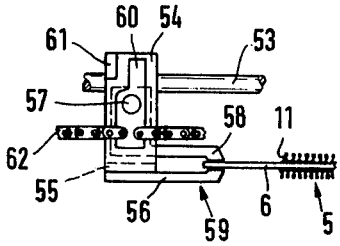
FIG. 3 is an enlarged partial side elevational view of the pull off mechanism.

The operation of the device is as follows:

At the start of an aligning and severing process, first a new towel section of the terry cloth 5 is pulled off the supply roll 4. For this purpose motor 63 is switched on, which drives chain 62 counterclockwise (according to FIG. 1). By the drive movement of chain 62 lever 60 is held in contact with the abutment piece 61 (FIG. 3) and thereby the drive movement is transmitted to shaft 57. In this way the guide pieces 54 on the guide rods 53 and the opened clamps 59 above the conveyor belts 71 are shifted counter to the pull off direction A, the folding stave 73 being lifted. The carriage 29 is then in retracted end position, in which the trigger plate 32 holds the supports 14 and hence the brake wheels 16 in upwardly pivoted position. In like manner also the aligning elements 46 and the severing knife 35 are in lifted position. Before the clamps reach the front end position, their arms 56 slide into the shallow grooves 68 of plate 36 and finally engage under the front edge of the terry cloth 5 lying on plate 36 or respectively over the grooves 68, which edge is aligned at right angles by the preceding aligning process and is held in the aligned position by the lowered pressing strip 27.

Figure 1:
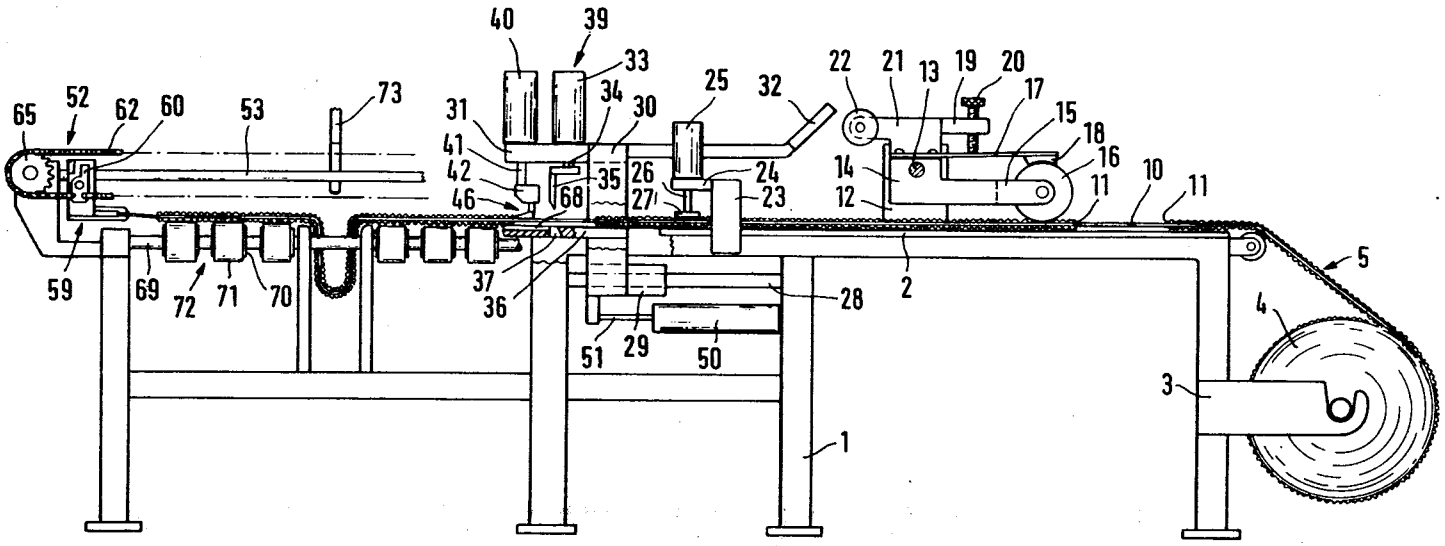
FIG. 1 is a side elevational view of a device for pulling off fabric from a reel supply and for aligning the fabric for cutting it into individual lengths constructed in accordance with the invention.
Figure 2:
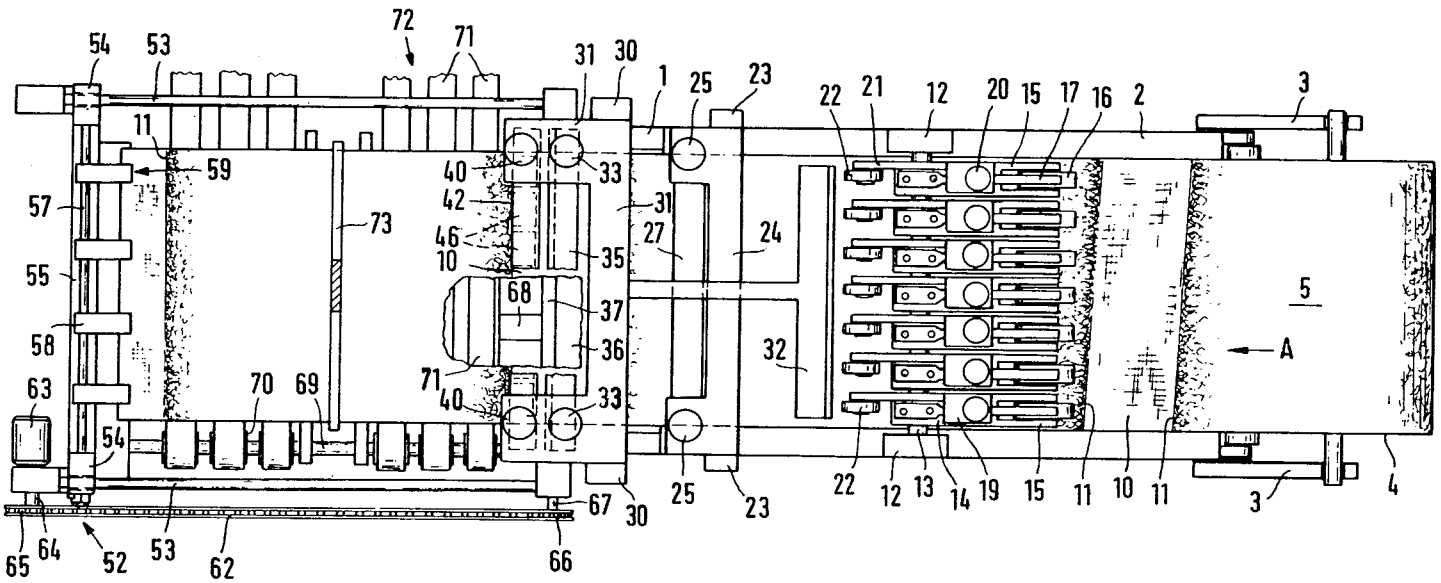
FIG. 2 is a top plan view of the device shown in FIG. 1.
Figure 4:
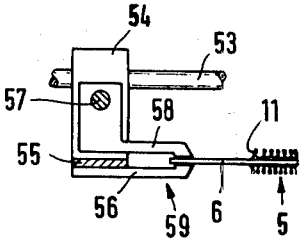
FIG. 4 is a view similar to FIG. 3 indicating the clamping of the fabric material.

As soon as the clamps 59 have reached the front end position, motor 63 is switched to the other direction of rotation, whereby it now drives chain 62 clockwise (according to FIG. 1). Thereby chain 62 exerts on lever 60 a tensile force, which rotates it clockwise (according to FIG. 3). This rotary movement is transmitted via shaft 57 to the angle pieces 58, which consequently likewise execute a clockwise rotary movement (according to FIG. 3 and 4). In this way the front edge of the terry cloth 5 is clamped between the arms 56 and the angle pieces 58. Only when thus the clamps 59 are closed and consequently the angle pieces 58 can execute no further rotary movement, the tensile force exerted by chain 62 on lever 60 causes shaft 57 and hence the guide pieces 54 and clamps 59 to be pulled along in pull off direction A. At the time the clamps 59 close, the pressing strip 27 is pulled up by the two compressed air cylinders 25, so that the clamps 59 can pull the terry cloth 5 off the supply roll 4 uninhindered. The length of terry cloth 5 pulled off the supply roll 4 by the pull off device 52 is shorter than the length of one towel section.

As soon as the clamps 59 have reached the rear end position, motor 63 is switched off. Thereupon, the clamps 59 remaining closed, the remaining portion of the towel section is pulled off by the folding stave 73, in that it pulls out the terry cloth 5 to a U-shaped fold between the middle conveyor belts 71. Thereby a shorter structural length of the entire system is achieved.

At the end of the pull off process, a napless lane 10 lies under the aligning elements 46. By actuating the compressed air cylinders 40, the aligning elements 46 lowered into lane 10. In so doing, the shoes 45 place themselves under light spring pressure onto the ground fabric 6 (FIG. 5). As soon as the aligning elememts 46 are lowered, the compressed air cylinder 50 is pressurized and carriage 29 displaced in pull off direction A. Thereby the trigger plate 32 moves away from the wheels 22, whereupon the supports 14 pivot clockwise according to FIG. 1 by their dead weight and the brake wheels 16 lay themselves on the terry cloth 5. By the displacement of carriage 29 also the aligning elements 46 are brought at the same time to the opposite boundary area 11 of the nap layer 9. If the terry cloth 5 is distorted, the aligning elements 46 touch first the portion of the boundary area 11 hanging farthest back, which lies in the zone of greatest distortion of the terry cloth 5. The respective aligning element 46 now pushes with its shoe against the nap layer 9 and exerts a tensile force on the portion of the terry cloth 5 situated between this portion of the boundary area 11 and the brake wheel 16 in line therewith, which force causes additional terry cloth 5 to be pulled through under said brake wheel 16 in this zone of strongest distortion. Meanwhile the adjacent portion of terry cloth 5, whose correlated boundary area 11 does not yet have contact with the respective aligning elements 46, at first retains its original position. To support this aligning movement, the brake force exerted by the individual brake wheels 16 is adapted to the distortion of the terry cloth 5 by turning the adjusting screws 20 in such a way that the brake wheels exert less brake force in the zone of strong distortion than in the zones of less distortion. By the cooperation of the aligning elements 46 and of the brake wheels 16, the boundary area 11 is thus more and more aligned in the course of the feed movement of carriage 29. until finally all alignment elements 46 apply against this boundary area 11 and thus not only said boundary area 11 but all weft threads 8 in the respective lane are aligned at right angles and rectilinearly.

When carriage 29 has reached its front end position, for example by striking against an adjustable abutment not shown, the supply of compressed air to the compressed air cylinder 50 is cut off. Thereupon first the two compressed air cylinders 25 and shortly thereafter the two compressed air cylinders 33 are pressurized with compressed air, whereby first the pressing strip 27 and then the severing knife 35 are lowered. The distance between the aligning elements 46 and the severing device 39 is adjusted so that the cut is made in the center of the lane 10. As the pressing strip 27 has been lowered onto the terry cloth before the cutting, it is prevented that the portion of the terry cloth 5 elastically stretched in part between the aligning element 46 and the brake wheels 16 will snap back into the starting position after execution of the cut. On the other hand, the towel section lying on the conveyor belts 71 need not be clamped. Since by the aligning the rear boundary area 11 is brought into the same right-angle and rectilinear aligned position as the front edge of the towel section clamped in clamps 59, the distortion between warp threads 7 and weft threads 8 is eliminated in this towel section. Moreover, the U-shaped fold formed between the middle conveyor belts 71 insures that in this towel section no elastic elongations can occur. Consequently the towel section stays in the aligned position on the conveyor belts 71 after the severing.

After the severing, the compressed air cylinders 33, 40 are pressurized with compressed air so that they pull the aligning elements 46 and the severing knife 35 up into the top position simultaneously. Then also the compressed air cylinder 50 is pressurized, which returns the carriage 29 into the rear starting position. In so doing, the trigger plate 32 slides over the wheels 22 and pivots the supports 14 counterclockwise according to FIG. 1, whereby the brake wheels 16 are again lifted off the terry cloth 5.

During the return of carriage 29, the folding stave 73 is lowered a second time and thereby the rear edge strip of the towel section is pulled down from plate 36. As soon as the folding stave 73 is moved upward again, motor 63 is switched on briefly so that it drives chain 62 conterclockwise (according to FIG. 1). Thereby chain 62 exerts on lever 60 a tensile force which pivots it counterclockwise (according to FIG. 3) up to the abutment piece 61. This rotary movement is transmitted through shaft 57 to the angle pieces 58, which consequently also execute a rotary movement counterclockwise (according to FIGS. 3 and 4) to open the clamps 59. After the clamps 59 have been opened, the cross conveyor device 72 is switched on, whose conveyor belts 71 then transport the severed towel section away from this system and introduce it for example into a hem-folding system not shown for further processing.

In this embodiment, the steps "pulling terry cloth 5 off the supply roll 4" and "aligning" are carried out one after the other. But as these two steps proceed in the same direction, they could occur so that there is overlapping in time. In this case, the carriage 29 carrying the aligning elements 46 would simply have to be driven at a greater speed in relation to the pull off speed of the terry cloth 5. Further also the steps "transporting the severed towel section away" and "advancing the clamps 59 to the front end position", which in the above example occur successively, could be carried out simultaneously or overlapping in time. In order that the clamps 59 can pass over the towel section, which is in part still lying on the conveyor belts 71 unhindered, a greater vertical distance than in the above example would then have to exist between the movement path of the clamps 59 and the conveyor belts 71. This can be achieved relatively easily for example by placing the conveyor belts 71 lower or by guiding the clamps 59 obliquely upwardly from the front to the rear end position. By these measures, the time for the execution of a complete aligning and severing process could be greatly shortened.

While specific embodiments of the invention have been shown and described in detail to illustrate the application of the principles of the invention, it will be understood that the invention may be embodied otherwise without departing from such principles.

What is claimed is:

1. A system for aligning and severing of fabric webs which have a thickness differing in the longitudinal direction, for example terry cloth having alternately arranged napless lanes and lanes having naps extending crosswise to the longitudinal direction, comprising a reel supply of fabric, pull off means engageable with said fabric to pull it off said reel supply and move it in a pull off direction, an aligning means cooperating with boundary areas between adjacent lanes of the fabric extending crosswise to the web pull off direction, cutting means operative crosswise to the web pull off direction for cutting the web across a lane, said aligning means comprising a plurality of laterally spaced shoes engageable with the fabric across its width and each shoe being displaceable parallel to the web pull off direction, and a plurality of brake elements arranged side by side crosswise to the pull off direction and acting on the fabric web between said reel supply and said aligning means, and means for adjusting the brake force of said brake elements independently of each other.

2. A system according to claim 1, wherein said aligning means comprises a plurality of individual aligning shoes arranged side by side across the width, means mounting said shoes for movement upwardly and downwardly in respect to the plane of movement of the said webs independently of each other and a carriage carrying said mounting means for movement in longitudinal directions.

3. A system according to claim 2, wherein said brake elememts are of a number corresponding to the number of said alignment shoes and are arranged in longitudinal alignment therewith.

4. A system according to claim 1, including a carriage movable backwardly and forwardly in respect to the pull off direction, means on said carriage for raising said plurality of brake elements, said cutting device comprising a knife extending across the width of said fabrics and movable perpendicularly to the plane thereof.

5. A system according to claim 4, including pressing means engageable with said fabric across at least a portion of its width for holding the fabric during cutting and after it has been aligned by said aligning means.

6. An apparatus for aligning a continuous fabric web having longitudinally extending areas of different thickness and which includes a thicker width area alternating with a thinner width area along the length thereof and with a boundary edge defined between each adjacent area, comprising a table over which the material is fed as it is drawn off a reel supply, means rotatably mounting the reel supply adjacent said table, a cutting device disposed across the table being movable through a plane of the table to sever the material, a carriage mounted on said table for movement in longitudinal directions, and an aligning device carried by said carriage and including a plurality of shoes extending across the width of the material in spaced lateral locations, biasing means effective when said aligning device is lowered to the material to press the individual shoes against the fabric material, means for raising and lowering said aligning device to engage the fabric material in the thinner width portions and to hold it by the operation of said biasing means on the individual shoes during movement of said carriage in a pull off direction whereby the shoes act to press against and partly slip over the thinner portions of the fabric until some alignment shoes engage against the boundary edge of the next adjacent thicker width portion and the others of said engagement members displace and distort the fabric web until the remaining shoes which remain in the aligned row with the other shoes substantially engage the boundary edge, a plurality of brake elements disposed across the fabric web between the reel supply of said aligning device, brake element mounting means supporting said brake elements for movement into and out of engagement with the fabric web, means for separately adjusting the braking force of each of said brake elements to vary the holding action thereof on the fabric web, said brake elements being engaged with said fabric web during movement of said carriage with said alignment device and cooperating with said alignment shoes to align the fabric web laterally in respect to the boundary edges between the adjacent areas of different thickness prior to it being cut by said cutting device, and pull off means engageable with said fabric web to pull off successive lengths of said fabric web from said reel supply and to position each area of lesser thickness into association with said alignment device.

7. An apparatus according to claim 6, wherein said alignment device has a trigger plate portion extending toward said brake element mounting means, said brake element mounting means including a pivotal double armed lever having a roller portion disposed adjacent said trigger in an opposite portion carrying a brake element, said trigger being movable with said adjustment device in said carriage to tilt said pivot arm of said brake mounting means for raising said brake elements off the fabric web when the fabric web is being pulled off.

8. An apparatus according to claim 7, wherein said pull off means comprises an endless chain, a gripping lever carried by said chain and being displaceable therewith to engage the forward edge of said fabric web, said table having a portion movable beyond said cutter means and said alignment means, and including a cut-out portion between said alignment means and said pull out member, and a stave mounted for vertical movement above said table over said cut-out portion for deflecting said web downwardly into the cut-out portion after it has been cut by said cutting device.

9. An apparatus according to claim 8, wherein said pull out gripping means moves with said chain from a position adjacent said alignment means in a direction away from said alignment means and away from said supply reel, said cutting device being disposed adjacent said guide means on the opposite sides from said pull out means, and including a presser mounted over said web on the other side of said cutter from said guiding means and means for moving said presser into engagement with the fabric web.

10. A method of unwinding and cutting a fabric web having an individual longitudinally adjacent length of thick width and thin width areas into individual lengths from a reel supply of the fabric, comprising pulling off a length of the fabric, engaging the fabric in a thin width area at a plurality of laterally aligned locations across the width thereof and with a predetermined engaging force while applying individual braking pressures at a number of locations corresponding to the engaging force areas between the reel supply and the engaging force areas and advancing the engaging force areas in the direction of pull off to permit a gradual slipping and alignment of the fabric as the engagement areas move toward a boundary line between the thin width and thick width areas so as to realign the fabric, and thereafter severing the fabric after it has been realigned into individual lengths.

11. A method according to claim 10, wherein the fabric is engaged by braking elements between the alignment means and the reel supply in a number and corresponding to the adjustment elements and at a location aligned longitudinally with the elements.

12. A method according to claim 10, wherein the fabric is held by presser means after it has been aligned and then it is cut into individual lengths.

13. A method according to claim 10, wherein the fabric is pulled by said pulling means over a recess so that the portion behind the recess includes an area disposed in alignment with the location on which the fabric is engaged by an engaging force across its width and including deflecting the fabric downwardly into the recess in order to advance the trailing end thereof.

* * * * *